US006180057B1

(12) United States Patent
Taylor et al.

(10) Patent No.: US 6,180,057 B1
(45) **Date of Patent: *Jan. 30, 2001**

(54) CORROSION INHIBITING COMPOSITIONS AND METHODS

(75) Inventors: Grahame N. Taylor, Houston, TX (US); Juanita M. Cassidy, Duncan, OK (US); Dennis A. Williams, Houston, TX (US); Gary P. Funkhouser, Duncan, OK (US)

(73) Assignees: Nalco/Exxon Energy Chemicals L.P., Naperville, IL (US); Halliburton Energy Services, Inc., Duncan, OK (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/099,704

(22) Filed: Jun. 19, 1998

(51) Int. Cl.[7] ..... C23F 11/00

(52) U.S. Cl. ..... 422/16; 252/390; 252/393; 252/394

(58) Field of Search ..... 422/12, 16; 252/388, 252/390, 393, 394

(56) References Cited

U.S. PATENT DOCUMENTS

| | | | | |
|---|---|---|---|---|
| 3,077,454 | | 2/1963 | Monroe et al. | 252/148 |
| 3,530,059 | | 9/1970 | Foroulis | 208/47 |
| 3,537,974 | | 11/1970 | Foroulis | 208/47 |
| 3,589,860 | | 6/1971 | Foroulis | 21/2.7 |
| 3,854,959 | | 12/1974 | Costain et al. | 106/14 |
| 4,493,775 | | 1/1985 | Coffey et al. | 252/8.55 |
| 4,525,296 | | 6/1985 | Quinlan | 252/391 |
| 4,734,259 | | 3/1988 | Frenier et al. | 422/16 |
| 4,980,074 | * | 12/1990 | Henson et al. . | |
| 5,120,356 | * | 6/1992 | Phillips et al. . | |
| 5,120,471 | * | 6/1992 | Jasinski et al. | 422/16 X |
| 5,366,643 | * | 11/1994 | Walker . | |
| 5,591,381 | * | 1/1997 | Walker | 422/16 X |

OTHER PUBLICATIONS

"Inhibition Of Steel Corrosion in HCl by Derivatives Of Cinnamaldehyde" Corrosion vol. 45 No. 12, pp. 1007–1015, 1989.

* cited by examiner

*Primary Examiner*—Elizabeth McKane
(74) *Attorney, Agent, or Firm*—Robert A. Kent; C. Clark Dougherty, Jr.

(57) ABSTRACT

Corrosion inhibiting compositions and methods for inhibiting the corrosion of metal surfaces by corrosive aqueous fluids are provided. In accordance with the invention, a corrosion inhibiting composition comprised of one or more aldehyde oligomers having the general formula

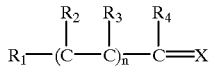

are combined with the corrosive aqueous fluid.

27 Claims, No Drawings

CORROSION INHIBITING COMPOSITIONS AND METHODS

BACKGROUND OF THE INVENTION

1. Field of the Invention

The present invention relates to corrosion inhibiting compositions and methods for inhibiting the corrosion of metal surfaces by corrosive aqueous fluids.

2. Description of the Prior Art

Subterranean hydrocarbon containing formations penetrated by well bores are often treated with aqueous acids to stimulate the production of hydrocarbons therefrom. One such treatment generally referred to as "acidizing" involves the introduction of an aqueous acid solution into a subterranean formation under pressure so that the acid solution flows through the pore spaces of the formation. The acid reacts with acid soluble materials contained in the formation thereby increasing the size of the pore spaces and increasing the permeability of the formation. Another production stimulation treatment known as "fracture-acidizing" involves the formation of one or more fractures in the formation and the introduction of an aqueous acid solution into the fractures to etch the fracture faces whereby channels are formed therein when the fractures close. The acid also enlarges the pore spaces in the fracture faces and in the formation.

While acidizing and fracture-acidizing well stimulation treatments have been performed successfully for many years, a continuous problem which accompanies the treatments is the corrosion of metal surfaces in pumps, tubular goods and equipment used to introduce aqueous acid solutions into the subterranean formations to be treated. The expense associated with repairing or replacing corrosion damaged tubular goods and equipment can be very high. The corrosion of tubular goods and down-hole equipment is increased by the elevated temperatures encountered in deep formations, and the corrosion results in at least the partial neutralization of the acid before it reacts with acid-soluble materials in the formations.

Aqueous acid solutions are also utilized in a variety of other industrial applications to contact and react with acid soluble materials. In such applications, metal surfaces are necessarily also contacted with the acid and any corrosion of the metal surfaces is highly undesirable. In addition, other corrosive fluids such as aqueous alkaline solutions, heavy brines, petroleum streams containing acidic materials and the like are commonly transported through and corrode metal surfaces in tubular goods, pipelines and pumping equipment.

A variety of metal corrosion inhibiting compositions and formulations which can be added to aqueous corrosive fluids have been developed and used heretofore. While such compositions and formulations have achieved varying degrees of success in preventing corrosion of metal surfaces, there is a continuing need for improved metal corrosion inhibiting compositions which are effective when combined with aqueous corrosive fluids of the types described above and which provide greater and more reliable corrosion inhibition than has heretofore been possible.

SUMMARY OF THE INVENTION

The present invention provides corrosion inhibiting compositions which when added to a corrosive aqueous fluid inhibit the corrosion of metal surfaces contacted thereby, metal corrosion inhibited aqueous acid compositions and methods of using the compositions which meet the needs described above and overcome the deficiencies of the prior art.

The compositions and methods of the present invention are based on the discovery that certain aldehyde oligomers formed by the condensation reaction of benzaldehyde and acetaldehyde provide unexpected increased corrosion inhibition when added to corrosive aqueous fluids as compared to prior art corrosion inhibiting compositions including aldehydes. Surprisingly, the aldehyde oligomers of this invention can be utilized directly in corrosive aqueous fluids without the use of a dispersing surfactant or mutual solvent. However, in preferred corrosion inhibiting compositions of this invention, a dispersing surfactant or a mutual solvent or both are included in the compositions.

A composition for inhibiting the corrosion of metal surfaces when added to a corrosive aqueous fluid of this invention basically comprises one or more aldehyde oligomers and derivatives thereof having the general formula

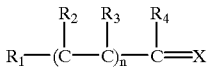

wherein:

$R_1$ is phenyl or a phenyl group substituted with one or more of the groups methyl, hydroxyl, methoxy or other substituent which does not have an adverse effect, $R_2$ and $R_3$ are individually hydrogen, a saturated or unsaturated aliphatic group having from 1 to about 12 carbon atoms, an aryl group or other substituent which does not have an adverse effect, $R_4$ is hydrogen, $—(NH—CH_2—CH_2—)_m—NH—CH_2CH_2NH_2$ where m is 0 or an integer in the range of from 1 to 5, a tris(2-aminoethyl)amine group or other substituent which does not have an adverse effect, n is an integer in the range of from 2 to 7, and X is oxygen, NH or other N-substituent which does not have an adverse effect.

As mentioned, the above described corrosion inhibiting composition can include a dispersing surfactant or a mutual solvent, or both, and in addition, one or more quaternary ammonium compounds, one or more corrosion inhibitor activators and other components commonly utilized in corrosion inhibiting formulations.

Metal corrosion inhibited aqueous acid compositions are also provided by this invention which are comprised of water, an acid selected from the group consisting of inorganic acids, organic acids and mixtures thereof and at least one aldehyde oligomer of the type described above.

In accordance with the methods of this invention, the corrosion of metal surfaces by a corrosive aqueous fluid is inhibited by combining a corrosion inhibiting composition including one or more of the above described aldehyde oligomers therewith.

It is, therefore, a general object of the present invention to provide improved corrosion inhibiting compositions and methods.

Other and further objects, features and advantages of the present invention will be readily apparent to those skilled in the art upon a reading of the description of preferred embodiments which follows.

DESCRIPTION OF PREFERRED EMBODIMENTS

The present invention provides improved corrosion inhibiting compositions which when combined with a corrosive aqueous fluid inhibit the corrosion of metal surfaces contacted thereby, improved corrosion inhibited aqueous acid compositions and improved methods of inhibiting the corrosion of metal surfaces by a corrosive aqueous fluid using the compositions.

The corrosion inhibiting compositions of the present invention are basically comprised of one or more aldehyde oligomers formed by the condensation reaction between benzaldehyde and acetaldehyde. It has been discovered that such oligomers provide surprisingly improved protection to metal surfaces from corrosion by corrosive aqueous fluids when one or more of the oligomers are combined with the corrosive aqueous fluids.

The aldehyde oligomers formed by the above described reaction which provide improved corrosion protection to metal surfaces in accordance with the present invention have the general formula

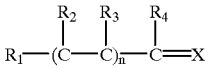

$R_1$ is phenyl or a phenyl group substituted with one or more of the groups methyl, hydroxyl, methoxy or other substituent which does not have an adverse effect, $R_2$ and $R_3$ are individually hydrogen, a saturated or unsaturated aliphatic group having from 1 to about 12 carbon atoms, an aryl group or other substituent which does not have an adverse effect, $R_4$ is hydrogen, $—(NH—CH_2—CH_2—)_m—NH—CH_2CH_2NH_2$ where m is 0 or an integer in the range of from 1 to 5, a tris(2-aminoethyl)amine group or other substituent which does not have an adverse effect, n is an integer in the range of from 2 to 7, and X is oxygen, NH or other N- substituent which does not have an adverse effect.

The substituents which do not have an adverse effect referred to above are those substituents which do not adversely interfere with the corrosion protection provided by the aldehyde oligomers and/or add to the corrosion protection provided. Examples of such substituents are halides, hydroxyl groups, alkoxy groups, hydrogen, aminoalkylamine groups, imidazoline groups and the like. The most preferred aldehyde oligomers as described above are those wherein $R_1$ is phenyl, $R_2$, $R_3$ and $R_4$ are hydrogen, X is oxygen and n is 2 or 3.

As mentioned, the corrosion inhibiting composition of this invention can also include a surfactant for dispersing the aldehyde in a corrosive aqueous fluid. Examples of suitable such dispersing surfactants are alkyoxylated fatty acids, alkylphenol alkoxylates and ethoxylated alkyl amines. When a dispersing surfactant of the type described above is utilized in a corrosion inhibiting composition of this invention, it is generally present in the composition in an amount in the range of from about 1% to about 45% by weight of the composition.

Another component which can be included in the corrosion inhibiting compositions is a solvent for the aldehyde oligomers which also dissolves in water, referred to herein as a "mutual solvent". Examples of such solvents are methyl alcohol, ethyl alcohol, isopropyl alcohol, ethylene glycol, propylene glycol, dimethyl formamide, N-methyl pyrrolidone, propylene glycol methyl ether and butyl cellosolve. When a mutual solvent of the type described above is included in a corrosion inhibiting composition of this invention, it is generally present in an amount in the range of from about 1% to about 40% by weight of the composition.

In addition, the corrosion inhibiting compositions can include one or more quaternary ammonium compounds, one or more corrosion inhibitor activators and other components commonly utilized in corrosion inhibiting formulations such as acetylenic alcohols, Mannich condensation products formed by reacting an aldehyde, a carbonyl containing compound and a nitrogen containing compound, unsaturated carbonyl compounds, unsaturated ether compounds, formamide, formic acid, other sources of carbonyl, iodides, terpenes, and aromatic hydrocarbons.

The quaternary ammonium compounds which function as corrosion inhibitors and can be utilized in accordance with the present invention have the general formula:

$$(R)_4N^+X^-$$

wherein each R is the same or a different group selected from long chain alkyl groups, cycloalkyl groups, aryl groups or heterocyclic groups, and X is an anion such as a halide. The term "long chain" is used herein to mean hydrocarbon groups having in the range of from about 12 to about 20 carbon atoms. Examples of quaternary ammonium compounds which can be included in the corrosion inhibiting composition of this invention are N-alkyl, N-cycloalkyl and N-alkylarylpyridinium halides such as N-cyclohexylpyridinium bromide or chloride, N-alkyl, N-cycloalkyl and N-alkylarylquinolinium halides such as N-dodecylquinolinium bromide or chloride, and the like. When a quaternary ammonium compound is included in a composition of this invention, it is generally present in an amount in the range of from about 1% to about 45% by weight of the composition.

Corrosion inhibitor activators function to activate corrosion inhibitor components such as quaternary ammonium compounds so that they function as corrosion inhibitors. Examples of such corrosion inhibitor activators which can be utilized in accordance with the present invention are cuprous iodide; cuprous chloride; antimony compounds such as antimony oxides, antimony halides, antimony tartrate, antimony citrate, alkali metal salts of antimony tartrate and antimony citrate, alkali metal salts of pyroantimonate and antimony adducts of ethylene glycol; bismuth compounds such as bismuth oxides, bismuth halides, bismuth tartrate, bismuth citrate, alkali metal salts of bismuth tartrate and bismuth citrate; iodine; iodide compounds; formic acid; and mixtures of the foregoing activators such as a mixture of formic acid and potassium iodide. When a corrosion inhibitor activator is included in a composition of this invention, it is generally present in an amount in the range of from about 0.1% to about 5.0% by weight of the composition.

As mentioned above, the corrosive aqueous fluids in which the corrosion inhibiting compositions of this invention are effective include aqueous solutions of inorganic acids, organic acids and mixtures thereof as well as aqueous alkaline solutions, heavy brine and hydrocarbons containing corrosive materials. The metals which can be protected from corrosion by the corrosion inhibiting compositions include, but are not limited to, ferrous metals such as iron and steel and non-ferrous metals such as aluminum, zinc and copper.

In order to inhibit the corrosion of metal surfaces of the types described above by a corrosive aqueous fluid, a corrosion inhibiting composition of this invention is combined with the corrosive aqueous fluid in an amount in the range of from about 0.05% to about 5% by weight of the corrosive aqueous fluid.

A metal corrosion inhibited aqueous acid composition of this invention for use in applications such as acidizing and fracture-acidizing is comprised of water, an acid selected from the group consisting of inorganic acids, organic acids and mixtures thereof, and at least one aldehyde oligomer having the general formula:

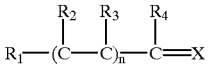

$R_1$ is phenyl or a phenyl group substituted with one or more of the groups methyl, hydroxyl, methoxy or other substituent which does not have an adverse effect, $R_2$ and $R_3$ are individually hydrogen, a saturated or unsaturated aliphatic group having from 1 to about 12 carbon atoms, an aryl group or other substituent which does not have an adverse effect, $R_4$ is hydrogen, $—(NH—CH_2—CH_2—)_m—NH—CH_2CH_2NH_2$ where m is 0 or an integer in the range of from 1 to 5, a tris(2-aminoethyl)amine group or other substituent which does not have an adverse effect, n is an integer in the range of from 2 to 7, and X is oxygen, NH or other N- substituent which does not have an adverse effect.

The acid utilized in the aqueous acid compositions of this invention is generally present in the composition in an amount in the range of from about 1% to about 30% by weight of water therein with the aldehyde oligomer or oligomers being present in an amount in the range of from about 0.01% to about 2% by weight of the water.

The aqueous acid compositions can also include a dispersing surfactant of the type described above in an amount in the range of from about 0.001% to about 10% by weight of the water in the compositions, and/or a mutual solvent of the type described above present in the compositions in an amount in the range of from about 0.001% to about 30% by weight of water.

The compositions can also include one or more quaternary ammonium compounds of the type described above present in an amount in the range of from about 0.001% to about 10% by weight of water in the compositions, and one or more corrosion inhibitor activators of the type described above present in an amount in the range of from about 0.001% to about 8% by weight of water in the composition. Other corrosion inhibiting components known to those skilled in the art can also be included in the aqueous acid compositions. As mentioned above, the most preferred aldehyde oligomers for use in the aqueous acid compositions of this invention are those wherein $R_1$ is phenyl, $R_2$, $R_3$ and $R_4$ are hydrogen, X is oxygen and n is 2 or 3.

The methods of this invention for inhibiting the corrosion of metal surfaces by a corrosive aqueous fluid basically comprise combining a corrosion inhibiting composition of this invention as described above with the corrosive aqueous fluid in the general amount of from about 0.05% to about 5% by weight of the corrosive aqueous fluid.

The aldehyde oligomers described above which are useful in accordance with this invention can be synthesized in accordance with the following procedure. 16 parts by weight benzaldehyde are suspended in 100 parts by weight of a 1 to 10 mass percent aqueous catalyst A and 100 parts by weight of a 1 to 10 mass percent catalyst B. Catalyst A and B are of the general formulae $M(OH)_x$ and/or $M(OR_1)_x$ wherein M is any group I or II metal and $R_1$ is an acyl group having 1 to 8 carbon atoms. The suspension is rapidly stirred and heated to a temperature ranging from about 25° C. to about 70° C. From about 13.2 parts by weight to about 52.8 parts by weight acetaldehyde is predissolved in from about 20 to about 50 parts by weight water. The resulting aqueous solution is slowly added to the benzylaldehyde suspension at a rate between about 0.005 and 2 milliliters per minute. After the addition has been completed, the suspension is stirred for a period up to about ten hours. The reaction product in the form of a lower oily layer is partitioned between an aqueous basic layer and an organic layer. The organic phase is dried and the thick dark orange viscous oil product is recovered.

In order to further illustrate the corrosion inhibiting compositions and methods of the present invention the following examples are given.

EXAMPLE 1

Synthesis reactions were carried out to produce aldehyde oligomers of the formula set forth above wherein n was 2 or more. Certain of the resulting aldehyde oligomers produced were added in amounts of 0.5 grams to 5 milliliter amounts of methyl alcohol combined with a polysorbate dispersing surfactant in a volume ratio of 4:1. Hydrochloric acid and water were then added to the oligomer solutions to produce aqueous 15% by weight hydrochloric acid solutions containing the oligomers. To test the corrosion inhibiting effectiveness of the oligomers, the test hydrochloric acid solutions were heated to 150° F., and N-80 carbon steel corrosion coupons were immersed in the solutions for time periods of approximately two and one-half hours while maintaining the temperatures of the solutions at 150° F. Corrosion rates were measured electrochemically by a combination of linear polarization resistance and Tafel measurements and are expressed in milli-inches per year (MPY) units.

For comparative purposes, an α,β-unsaturated aldehyde utilized heretofore as a component in a corrosion inhibiting composition and described in U.S. Pat. No. 4,734,259 issued to Frenier, et al. on Mar. 29, 1988, i.e., cinnamaldehyde, was also tested following the identical procedure described above.

The result of these tests are set forth in Table I below.

TABLE I

CORROSION TESTS

| Aldehyde or Aldehyde Oligomer Tested | Solubilility Observation | Corrosion Rate, MPY |
|---|---|---|
| $C_6H_5—[CH=CH]_2—CH=O$ | Clear | 3.8 (5.6)[1] |
| $C_6H_5—[CH=CH]_4—CH=O$ | Cloudy | 4.4 (3.4)[1] |
| $C_6H_5—[CH=CH]_5—CH=O$ | Cloudy | 11 (12)[1] |
| $C_6H_5—[CH=CH]_6—CH=O$ | Cloudy | 8.9 (10)[1] |
| $C_6H_5—[CH=CH]_7—CH=O$ | Cloudy | 9.0 (13)[1] |
| $C_6H_5—[CH=CH]_6—CH=O$ | Cloudy | 34 (35)[1] |
| Cinnamaldehyde | Cloudy | 21 |

[1]A second test result is shown in parentheses

From the test results shown in Table I, it can be seen that the aldehyde oligomers utilized in accordance with the present invention provide improved corrosion protection as compared to the α,β-unsaturated aldehyde, i.e., cinnamaldehyde.

EXAMPLE 2

A corrosion test was performed using an aldehyde oligomer of this invention synthesized with a 1:4 ratio of benzaldehyde to acetaldehyde. The test procedure utilized was the same as described in Example 1 above except that the methyl alcohol mutual solvent and the dispersing surfactant were omitted. That is, 0.5 grams of the oligomer were mixed with water and hydrochloric acid to make a 15% by weight acid solution which was tested as described in Example 1. The results of this test is set forth in Table II below.

TABLE II

| Aldehyde Oligomer Tested | Solubilility Observation | Corrosion Rate, MPY |
|---|---|---|
| $C_6H_5$—[CH=CH]$_4$—CH=O | non-dispersed | 3.8 |

Thus, the present invention is well adapted to carry out the objects and attain the features and advantages mentioned as well as those which are inherent therein. While numerous changes may be made by those skilled in the art, such changes are encompassed within the spirit of this invention as defined by the appended claims.

What is claimed is:

1. A composition for inhibiting the corrosion of metal surfaces by a corrosive aqueous fluid when the composition is added to the corrosive aqueous fluid comprising one or more aldehyde oligomers having the general formula:

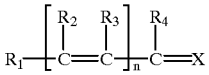

wherein:

$R_1$ is phenyl or a phenyl group substituted with one or more of the groups methyl, hydroxyl or methoxy, $R_2$ and $R_3$ are individually hydrogen, a saturated or unsaturated aliphatic group having from 1 to about 12 carbon atoms or an aryl group, $R_4$ is hydrogen, —(NH—$CH_2$—$CH_2$—)$_m$—NH—$CH_2CH_2NH_2$ where m is 0 or an integer in the range of from 1 to 5 or a tris(2-aminoethyl) amine group, n is an integer in the range of from 3 to 7, X is oxygen, NH or with $R_4$ and the carbon atom forms an imidazoline group, and said one or more aldehyde oligomers being formed by the condensation reaction of benzaldehyde and acetaldehyde in an aqueous catalyst solution.

2. The composition of claim 1 which further comprises a surfactant for dispersing said aldehyde oligomers in the corrosive aqueous fluid.

3. The composition of claim 2 wherein said surfactant is selected from the group consisting of alkyoxylated fatty acids, alkylphenol alkoxylates and ethoxylated alkyl amines.

4. The composition of claim 1 which further comprises a solvent for said aldehyde oligomers which also dissolves in water.

5. The composition of claim 4 wherein said solvent is selected from the group consisting of methyl alcohol, ethyl alcohol, isopropyl alcohol, ethylene glycol, propylene glycol methyl ether and butyl cellosolve.

6. The composition of claim 1 which further comprises one or more quaternary ammonium compounds.

7. The composition of claim 1 which further comprises a corrosion inhibitor activator.

8. The composition of claim 7 wherein said corrosion inhibitor activator is selected from the group consisting of cuprous iodide, cuprous chloride, antimony compounds, bismuth compounds, iodine, iodide compounds, formic acid and mixtures thereof.

9. The composition of claim 1 wherein $R_1$ is phenyl, $R_2$ $R_3$ and $R_4$ are hydrogen, X is oxygen and n is 3.

10. A metal corrosion inhibited aqueous acid composition comprising:

water;

an acid selected from the group consisting of inorganic acids, organic acids and mixtures thereof present in an amount in the range of from about 1% to about 30% by weight of water in said composition; and at least one aldehyde oligomer having the general formula:

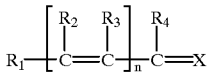

wherein:

$R_1$ is phenyl or a phenyl group substituted with one or more of the groups methyl, hydroxyl or methoxy, $R_2$ and $R_3$ are individually hydrogen, a saturated or unsaturated aliphatic group having from 1 to about 12 carbon atoms or an aryl group, $R_4$ is hydrogen, —(NH—$CH_2$—$CH_2$—)$_m$—NH—$CH_2CH_2NH_2$ where m is 0 or an integer in the range of from 1 to 5 or a tris(2-aminoethyl) amine group, n is an integer in the range of from 3 to 7, X is oxygen, NH or, with $R_4$ and the carbon atom forms an imidazoline group, and said aldehyde oligomer being formed by the condensation reaction of benzaldehyde and acetaldehyde in an aqueous catalyst solution and being present in an amount in the range of from about 0.01% to about 2% by weight of water in said composition.

11. The composition of claim 10 which further comprises a surfactant for dispersing said aldehyde oligomer in said composition present in an amount in the range of from about 0.001% to about 10% by weight of said water in said composition.

12. The composition of claim 11 wherein said surfactant is selected from the group consisting of alkyoxylated fatty acids, alkylphenol alkoxylates and ethoxylated alkyl amines.

13. The compositions of claim 10 which further comprises a solvent for said aldehyde which also dissolves in water.

14. The composition of claim 13 wherein said solvent is selected from the group consisting of methyl alcohol, ethyl alcohol and isopropyl alcohol, ethylene glycol, propylene glycol methyl ether, and butyl cellosolve.

15. The composition of claim 10 which further comprises one or more quaternary ammonium compounds present in an amount in the range of from about 0.001% to about 10% by weight of said water in said composition.

16. The composition of claim 10 which further comprises a corrosion inhibitor activator present in an amount in the range of from about 0.001% to about 8% by weight of said water in said composition.

17. The composition of claim 16 wherein said corrosion inhibitor activator is selected from the group consisting of cuprous iodide, cuprous chloride, antimony compounds, bismuth compounds, iodine, iodide compounds, formic acid and mixtures thereof.

18. The composition of claim 10 wherein $R_1$ is phenyl, $R_2$, $R_3$ and $R_4$ are hydrogen, X is oxygen and n is 3.

19. A method of inhibiting the corrosion of metal surfaces by a corrosive aqueous fluid comprising combining a corrosion inhibiting composition with said corrosive aqueous fluid, said corrosion inhibiting composition being comprised of one or more aldehyde oligomers having the formula

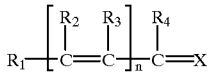

wherein:

$R_1$ is phenyl or a phenyl group substituted with one or more of the groups methyl, hydroxyl or methoxy, $R_2$ and $R_3$ are individually hydrogen, a saturated or unsaturated aliphatic group having from 1 to about 12 carbon atoms or an aryl group, $R_4$ is hydrogen, $—(NH—CH_2—CH_2—)_m—NH—CH_2CH_2NH_2$ where m is 0 or an integer in the range of from 1 to 5 or a tris(2-aminoethyl) amine group, n is an integer in the range of from 3 to 7, X is oxygen, NH or with $R_4$ and the carbon atom forms an imidazoline group, and said one or more aldehyde oligomers being formed by the condensation reaction of benzaldehyde and acetaldehyde in an aqueous catalyst solution.

20. The method of claim 19 wherein said corrosion inhibiting composition further comprises a surfactant for dispersing said aldehyde oligomers in said corrosive aqueous fluid.

21. The method of claim 19 wherein said corrosion inhibiting composition further comprises a solvent for said aldehyde which also dissolves in water.

22. The method of claim 19 wherein said corrosion inhibiting composition further comprises one or more quaternary ammonium compounds.

23. The method of claim 19 wherein said corrosion inhibiting composition further comprises a corrosion inhibitor activator.

24. The method of claim 19 wherein $R_1$ is phenyl, $R_2$, $R_3$ and $R_4$ are hydrogen, X is oxygen and n is 3.

25. The composition of claim 1 wherein said catalyst is selected from the group consisting of a compound having the formula $M(OH)_x$, a compound having the formula $M(OR_1)_x$ and a mixture of such compounds wherein M is any Group I or Group II metal and $R_1$ is an acyl group having 1 to 8 carbon atoms.

26. The composition of claim 10 wherein said catalyst is selected from the group consisting of a compound having the formula $M(OH)_x$, a compound having the formula $M(OR_1)_x$ and a mixture of such compounds wherein M is any Group I or Group II metal and $R_1$ is an acyl group having 1 to 8 carbon atoms.

27. The method of claim 19 wherein said catalyst is selected from the group consisting of a compound having the formula $M(OH)_x$, a compound having the formula $M(OR_1)_x$ and a mixture of such compounds wherein M is any Group I or Group II metal and $R_1$ is an acyl group having 1 to 8 carbon atoms.

* * * * *